US009228427B2

(12) United States Patent
Al-Ajmi

(10) Patent No.: US 9,228,427 B2
(45) Date of Patent: Jan. 5, 2016

(54) COMPLETION METHOD TO ALLOW DUAL RESERVOIR SATURATION AND PRESSURE MONITORING

(75) Inventor: Fahad Al-Ajmi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 796 days.

(21) Appl. No.: 13/329,514

(22) Filed: Dec. 19, 2011

(65) Prior Publication Data

US 2013/0105150 A1 May 2, 2013

Related U.S. Application Data

(60) Provisional application No. 61/552,175, filed on Oct. 27, 2011.

(51) Int. Cl.
*E21B 47/00* (2012.01)
*E21B 43/14* (2006.01)
*E21B 43/12* (2006.01)

(52) U.S. Cl.
CPC ..... *E21B 47/00* (2013.01); *E21B 43/14* (2013.01); *E21B 43/12* (2013.01)

(58) Field of Classification Search
CPC ..... E21B 43/14; E21B 47/00; E21B 43/12
USPC ..... 166/254.2, 113, 313
See application file for complete search history.

(56) References Cited

U.S. PATENT DOCUMENTS 3,283,570 A 11/1966 Hodges
3,437,142 A * 4/1969 Conover ..... 166/277
4,655,286 A 4/1987 Wood
4,827,765 A * 5/1989 Kessler ..... 73/152.35
5,055,676 A * 10/1991 Roscoe et al. ..... 250/269.7
5,447,201 A 9/1995 Mohn
5,662,165 A 9/1997 Tubel et al.
5,671,809 A 9/1997 McKinzie
6,018,496 A * 1/2000 Stanke et al. ..... 367/35

(Continued)

OTHER PUBLICATIONS

I.D. Bryant, "Well-bore reservoir evaluation technologies to optimize field revitalization," Petroleum Geoscience, Dec. 2002, at p. 339.

(Continued)

*Primary Examiner* — Jennifer H Gay
*Assistant Examiner* — George Gray
(74) *Attorney, Agent, or Firm* — Bracewell & Giuliani LLP; Constance Gall Rhebergen; Keith R. Derrington

(57) ABSTRACT

A well completion method provides for monitoring of reservoir pressure and saturation levels for two reservoirs from a single monitoring well. The well completion extends vertically through an upper and a lower reservoir. The well is cased, cemented, and perforated across the lower reservoir. A cement free zone is formed by cementing the casing string within the wellbore above an external casing packer above the upper reservoir. The casing string is perforated to allow fluid from the upper reservoir to flow through the cement free zone. A tubing string is landed and set within the casing string. The tubing string is sealed above and below the perforation at the cement free zone to prevent communication between fluid from the upper reservoir and the lower reservoir. The upper reservoir is monitored at the cement free zone, and the lower reservoir is monitored below an end of the tubing string.

26 Claims, 5 Drawing Sheets

(56) References Cited

U.S. PATENT DOCUMENTS

| | | | | |
|---|---|---|---|---|
| 6,098,020 | A | 8/2000 | den Boer | |
| 6,422,312 | B1 | 7/2002 | Delatorre et al. | |
| 6,426,917 | B1 | 7/2002 | Tabanou et al. | |
| 6,865,933 | B1 | 3/2005 | Einarson et al. | |
| 7,059,428 | B2 | 6/2006 | Frey et al. | |
| 7,219,730 | B2 | 5/2007 | Tilton et al. | |
| 7,397,388 | B2 * | 7/2008 | Huang et al. | 340/853.3 |
| 7,818,071 | B2 | 10/2010 | Hartkamp et al. | |
| 7,913,554 | B2 | 3/2011 | Bittleston et al. | |
| 2005/0211433 | A1 * | 9/2005 | Wilson et al. | 166/254.2 |
| 2005/0217350 | A1 * | 10/2005 | Jabusch et al. | 73/64.55 |
| 2006/0124310 | A1 | 6/2006 | Lopez de Cardenas et al. | |
| 2007/0162235 | A1 * | 7/2007 | Zhan et al. | 702/6 |
| 2009/0188666 | A1 | 7/2009 | Habib et al. | |
| 2010/0155077 | A1 | 6/2010 | De Azevedo et al. | |
| 2011/0139445 | A1 * | 6/2011 | Fripp et al. | 166/250.15 |
| 2011/0259595 | A1 * | 10/2011 | Nguy et al. | 166/332.1 |

OTHER PUBLICATIONS

"Taking Samples Through Casing," Middle East & Asia Reservoir Review, No. 7, 2006, at 34.

PCT International Search Report and the Written Opinion of the International Searching Authority dated Dec. 18, 2013; International Application No. PCT/US2012/062099; International File Date: Oct. 26, 2012.

* cited by examiner

COMPLETION METHOD TO ALLOW DUAL RESERVOIR SATURATION AND PRESSURE MONITORING

RELATED APPLICATIONS

This application claims priority to and the benefit of U.S. Provisional Application No. 61/552,175, filed on Oct. 27, 2011, entitled "Completion Method to Allow Dual Reservoir Saturation and Pressure Monitoring" to Fahad Al-Ajmi, which application is hereby incorporated in its entirety herein by reference.

BACKGROUND OF THE INVENTION

1. Field of the Invention

The present invention relates in general to well monitoring and, in particular, to a well completion method to allow dual reservoir saturation and pressure monitoring.

2. Brief Description of Related Art

In conventional oil and gas production operations, a production well may be drilled into a subsurface fluid reservoir and completed for the production of reservoir fluid to the surface. Generally, a monitoring well may be drilled into the same reservoir as the production well. These monitoring wells provide information regarding the reservoir so that production may be controlled to maintain production at desired levels. The monitored information may include reservoir pressure, reservoir saturation levels, and the like.

The monitoring well will be drilled to the reservoir depth and completed by suspending a casing string within the wellbore. The annulus between the casing string and the wellbore will be cemented to secure the casing string within the wellbore. The casing string may be perforated at the reservoir location to allow fluid flow from the reservoir into the casing string. A tubing string will then be run and set to the casing string through the use of tubing packers so that an end of the tubing string is above the reservoir. A pressure monitoring gauge will be mounted to the end of the tubing string to monitor the reservoir pressure. Saturation and production logging may be performed through the perforated portions of the casing string located at the reservoir. Generally, pressure monitoring, saturation logging, and production logging occur proximate to, or below an end of the tubing string. In particular, saturation logging involves measurement of the pore volume of a reservoir formation that is filled by water, oil, and/or gas. Typically, acoustic or electromagnetic signals are passed into the formation through the monitoring well to generate saturation data. The signals must pass through the casing string wall and the cement layer to penetrate the formation.

Some production wells will be drilled through two reservoirs. In the corresponding production operations, reservoir fluid may be produced from both reservoirs. As a consequence, both reservoirs must be monitored. To obtain accurate pressure and saturation measurements, separate monitoring wells must be drilled to each reservoir. This is extremely costly and inefficient, essentially doubling the cost of reservoir monitoring.

Some attempts have been made to monitor two reservoirs from a single well. In these monitoring well completions, a single wellbore is drilled through both reservoirs. A casing string is then set and cemented in the wellbore. The cement layer in the annulus between the casing string and the wellbore will extend from the bottom of the well to the surface. The casing string is then perforated at both reservoirs. A tubing string is then run and set within the casing string. The tubing string will be set with a lower packer in between the reservoirs and an upper packer above the upper reservoir. Again, pressure monitoring, saturation logging, and production logging for the lower reservoir will all be conducted proximate to or below the end of the tubing string. However, this only provides accurate measurements of the lower reservoir.

Attempts have been made to conduct saturation logging operations across the upper reservoir. When this is attempted, the saturation logging signal must pass through the tubing string wall, an annulus between the tubing string and the casing string, the casing string wall, and the cement layer before entering the reservoir. The addition of the tubing string wall and annulus between the tubing string and the casing string may significantly decrease the strength of the saturation logging signals. As a consequence, the information generated during the saturation logging operations for the upper reservoir may be highly inaccurate. In addition, pressure monitoring is not possible due to the inability to isolate flow from the two reservoirs when a pressure gauge is used to monitor the upper reservoir. Therefore, there is a need for a well completion method that allows for accurate monitoring of pressure and saturation of more than one reservoir from the same well.

SUMMARY OF THE INVENTION

These and other problems are generally solved or circumvented, and technical advantages are generally achieved, by preferred embodiments of the present invention that provide a well completion method to allow dual reservoir monitoring of saturation and pressure.

In accordance with an embodiment of the present invention, a well completion method is disclosed. The method drills a wellbore through an upper reservoir and a lower reservoir, wherein the upper reservoir is at a higher elevation than the lower reservoir and runs a casing string through the upper and the lower reservoir. The method sets a lower external casing packer between the upper and the lower reservoirs in an outer annulus between the outer diameter of the casing string and the wellbore and sets an upper external casing packer in the outer annulus above the upper reservoir. The method cements the outer annulus below the lower external casing packer, and cements the outer annulus above the upper external casing packer, thereby creating a cement free zone in the outer annulus between the lower external casing packer and the upper external casing packer to facilitate logging measurements of the upper reservoir.

In accordance with another embodiment of the present invention, a monitoring well for pressure and saturation monitoring of two subsurface fluid reservoirs is disclosed. The two reservoirs are at different vertical elevations. The well includes a wellbore drilled from a surface through the upper reservoir and the lower reservoir, and a casing string disposed within the wellbore so that the casing string extends through the upper reservoir and into the lower reservoir. A lower external casing packer is set at an elevation between the lower reservoir and the upper reservoir, and an upper external casing packer is set at an elevation above the upper reservoir. An outer annulus between the casing string and the wellbore is cemented below the lower external casing packer and above the upper external casing packer to create a cement free zone that facilitates logging measurements of the upper reservoir.

In accordance with yet another embodiment of the present invention, a system for monitoring pressure and saturation of two reservoirs from a single well is disclosed. The system includes a wellbore drilled through an upper reservoir and a lower reservoir, and a casing string suspended within the wellbore. The casing string defines a wellbore annulus between the casing string and the wellbore. A tubing string is suspended within the casing string. The tubing string defines a tubing string annulus between the tubing string and the casing string. The wellbore annulus is cemented across the lower reservoir and uncemented across the upper reservoir to create a cement free zone. A lower tubing packer set above the upper reservoir, and a lower monitoring gauge is mounted on the tubing string below the lower packer for monitoring pressure of the lower reservoir. An upper gauge is mounted above the lower packer for monitoring pressure of the upper reservoir. An upper tubing packer is set above the upper gauge.

An advantage of a preferred embodiment is that the apparatus provides a well completion method that allows reservoir independent pressure monitoring for two reservoirs, an upper reservoir and a lower reservoir, from a single well. In addition, the well completion method creates a cement free zone in an annulus between a casing string and a wellbore that allows for communication within the upper reservoir while facilitating logging of the upper reservoir as there is only one casing string between the logging tools and the formation. This results in accurate reservoir saturation monitoring for both the upper and the lower reservoirs. Still further, the disclosed well completion method facilitates running production logging for the lower reservoir.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning wellbore drilling, casing and tubing string run-in, packer setting, and the like have been omitted inasmuch as such details are not considered necessary to obtain a complete understanding of the present invention, and are considered to be within the skills of persons skilled in the relevant art.

Figure 1:
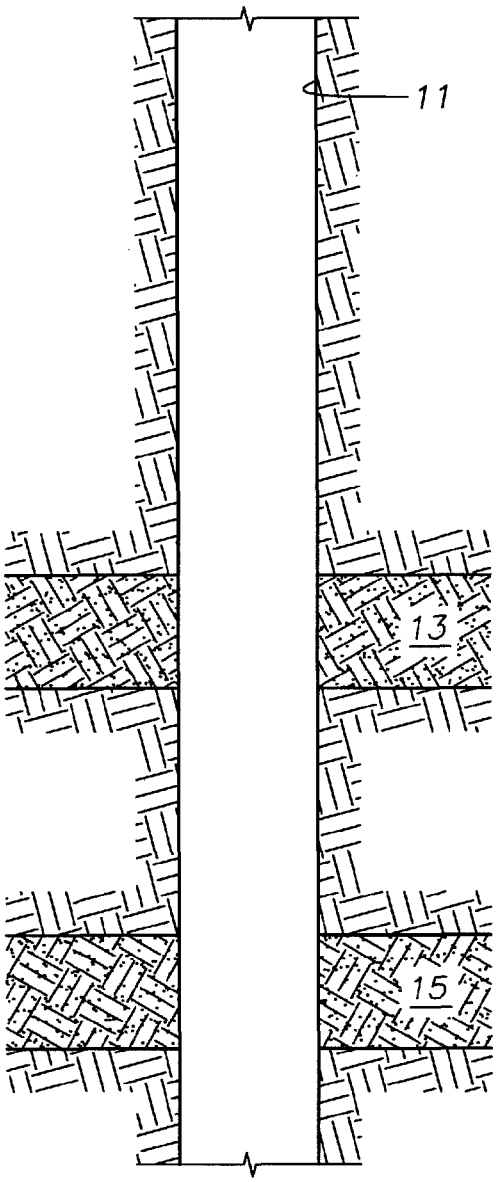
FIGS. 1-7 are schematic representations of a wellbore completion method in accordance with the disclosed embodiments.

Referring to FIG. 1, a wellbore 11 may be drilled vertically through an upper reservoir 13 and a lower reservoir 15. In the illustrated embodiment, upper reservoir 13 is at a higher elevation, i.e. closer to the surface, and lower reservoir 15 is at a lower elevation, i.e. farther from the surface. In the illustrated embodiment, at least a portion of upper reservoir 13 is aligned with at least a portion of lower reservoir 15 so that a well drilled perpendicular to the surface may penetrate both upper reservoir 13 and lower reservoir 15 as shown in FIG. 1. A person skilled in the art will understand that wellbore 11 may also be directionally drilled at an angle to the surface. In these alternative embodiments, upper reservoir 13 may not be vertically aligned with lower reservoir 15, yet upper reservoir 13 and lower reservoir 15 will be proximate to each other so that a directionally drilled well may penetrate both upper reservoir 13 and lower reservoir 15.

Figure 2:
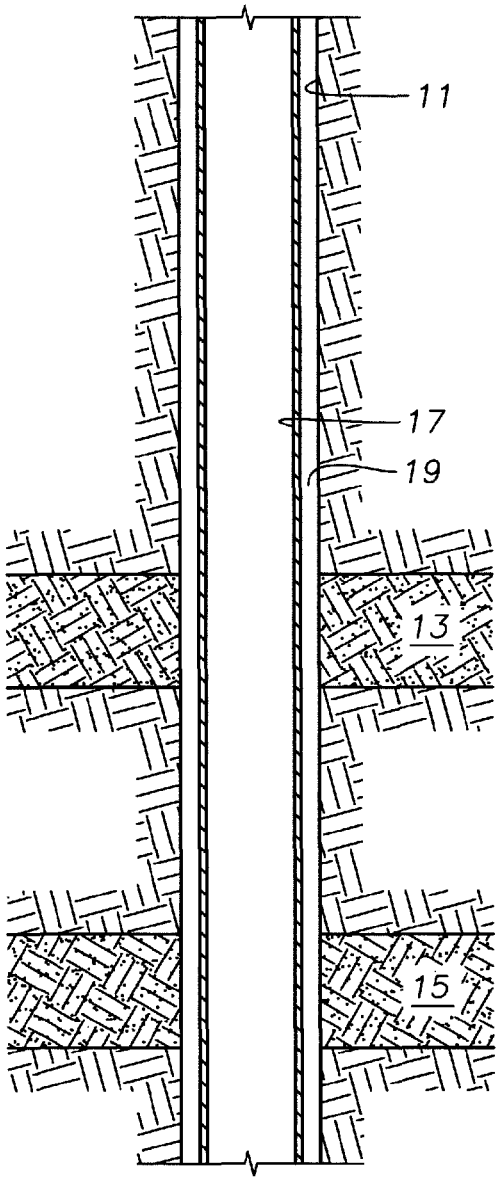
Figure 3:
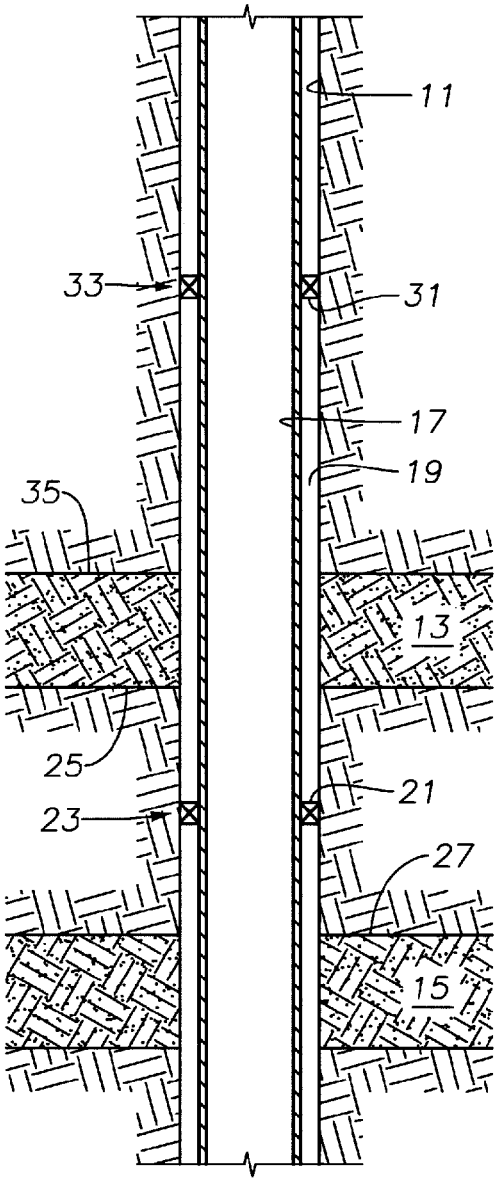

Referring to FIG. 2, a casing string 17 may be run into wellbore 11. Casing string 17 may run from the surface to a bottom of wellbore 11. In some embodiments, casing string 17 may not extend to the bottom of wellbore 11; however, casing string 17 may still run through upper reservoir 13 and lower reservoir 15 as illustrated in FIG. 2. Casing string 17 will define an outer annulus 19 between casing string 17 and wellbore 11. As shown in FIG. 3, a lower external casing packer 21 and an upper external casing packer 31 may then be run in with casing string 17 and set in outer annulus 19. Lower external casing packer 21 will be set at an elevation 23 between a lower edge 25 of upper reservoir 13 and an upper edge 27 of lower reservoir 15. A person skilled in the art will understand that edges of upper reservoir 13 and lower reservoir 15 are not clearly defined boundaries; rather, edges of upper reservoir 13 and lower reservoir 15 are regions within a formation in which the reservoir formations transition from areas containing fluids that are desired to be produced and areas not containing fluids that are desired to be produced. Thus, elevation 23 is an area of the formation that exists somewhere between upper reservoir 13 and lower reservoir 15 but fully in neither reservoir.

Upper external casing packer 31 may be set in outer annulus 19. Upper external casing packer 31 will be set at an elevation 33 above an upper edge 35 of upper reservoir 13. A person skilled in the art will understand that upper edge 35 of upper reservoir 13 is not a clearly defined boundary; rather, upper edge 35 of upper reservoir 13 is a region within a formation in which the reservoir formation transitions from areas containing fluids that are desired to be produced and areas not containing fluids that are desired to be produced. Thus, elevation 33 is an area of the formation that exists somewhere above upper reservoir 13 but not fully within upper reservoir 13. In the disclosed embodiments, elevation 33 of external casing packer 31 will be at a sufficient distance to allow for a saturation logging operation of upper reservoir 13 to be conducted below upper external casing packer 31, as described in more detail below.

Figure 4:
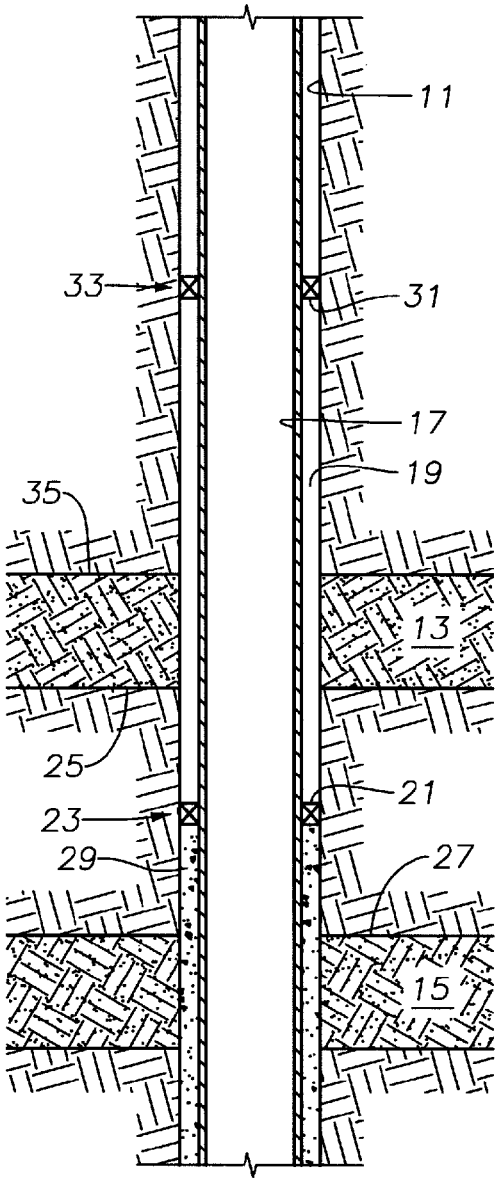

Referring to FIG. 4, outer annulus 19 will be cemented below lower external casing packer 21. Lower external casing packer 21 may include flow ports and check valves to allow for venting of drilling mud in outer annulus 19 below lower external casing packer 21 to flow upwards as the drilling mud is supplanted with cement. In an alternative embodiment, lower external casing packer 21 may not include flow ports and check valves for drilling mud venting. In the alternative embodiment, the cementing operation may take place before setting of lower external casing packer 21 to allow drilling mud to circulate around lower external casing packer 21. Lower external casing packer 21 may then be set to seal outer annulus 19 after cementing. As shown, in both embodiments, cementing will form a cement layer 29 that crosses lower reservoir 15 in outer annulus 19 extending from lower external casing packer 21 to a bottom of the well. Cement layer 29 will extend across the entirety of the vertical elevation of lower reservoir 15. A person skilled in the art will understand that cement layer 29 may not extend to the bottom of wellbore 11.

Figure 5:
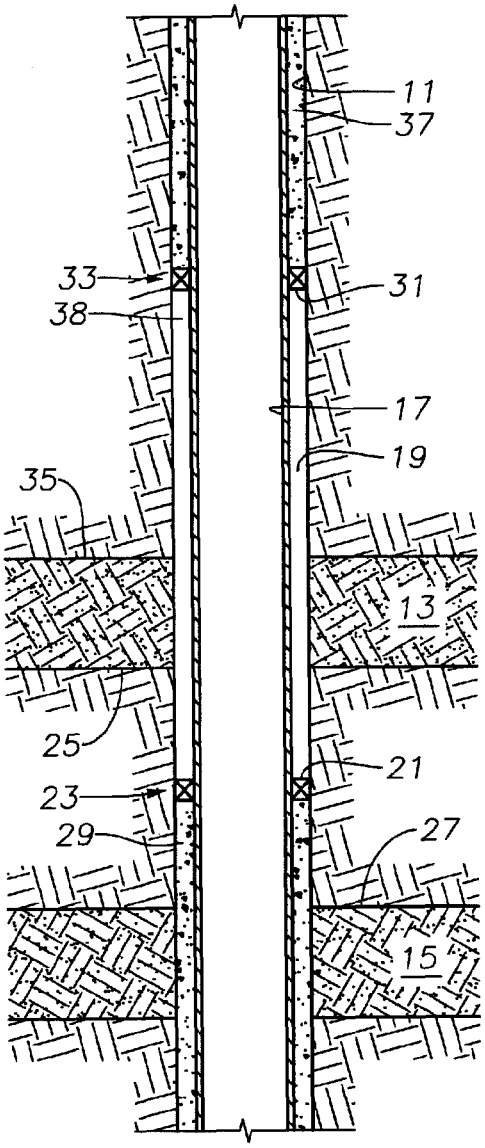

Referring to FIG. 5, outer annulus 19 will be cemented above upper external casing packer 31. As shown, this will form a cement layer 37 in outer annulus 19 extending from upper external casing packer 31 to the surface of wellbore 11. Cement layer 37 will prevent or inhibit flow of reservoir fluid from upper reservoir 13 through outer annulus 19 above elevation 33. Similarly, lower external casing packer 21 and cement layer 29 prevent flow of reservoir fluid from upper reservoir 13 through outer annulus 19 below elevation 23. Creating cement layer 37 and cement layer 29 in this manner will provide a cement free zone 38 in the annulus between wellbore 11 and casing string 17. A person skilled in the art will understand that, in alternative embodiments, cement layer 37 may not extend to the surface of wellbore 11.

Cementing above upper external casing packer 31 may be performed in any suitable manner. In an exemplary embodiment, casing string 17 may be perforated above upper external casing packer 31. A drill string carrying a squeegee tool may be run into casing string 17 proximate to upper external casing packer 31. The squeegee tool may set a releasable plug in casing string 17 to block flow of fluid past upper external casing packer 31 within casing string 17. Cement may then be pumped down the drill string to an area proximate to the perforations above upper external casing packer 31. The cement will flow through the perforations into outer annulus 19 and displace drilling mud in outer annulus 19. Sufficient pressure may be maintained on the flowing cement to lift the drilling mud to the surface through outer annulus 19 as cement fills outer annulus 19 above upper external casing packer 31 to form cement layer 37. Once sufficient cement fills outer annulus 19, a plug or ball may be pumped down the drill string to force any cement within the drill string into outer annulus 19. The squeegee tool will then release the releasable plug, and the squeegee tool and plug will be retrieved to the surface. A person skilled in the art will understand that other suitable methods to cement above upper external casing packer 31 are contemplated and included in the disclosed embodiments.

Figure 6:
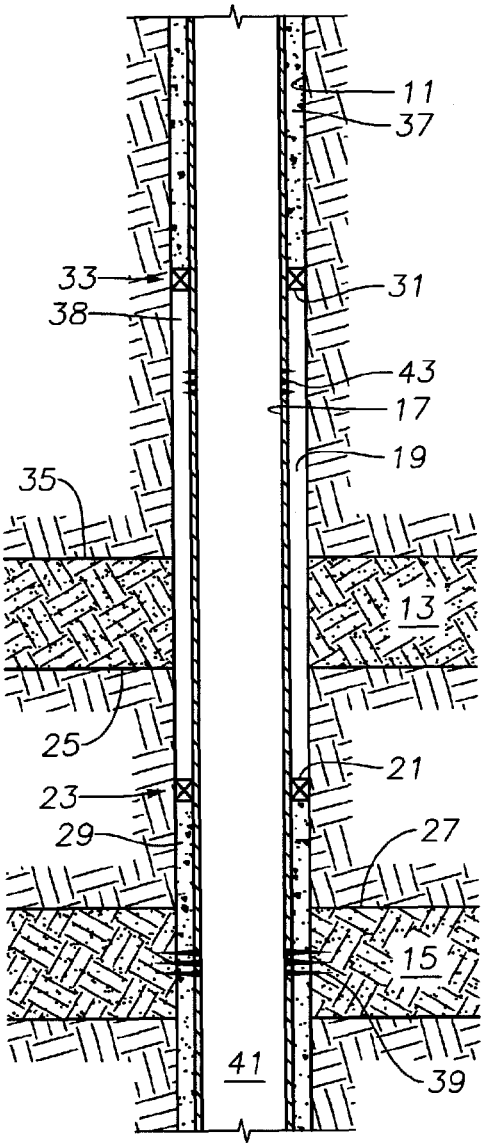

Referring to FIG. 6, casing string 17 may be perforated in at least two places following formation of cement layer 37. An upper perforation 43 may be located above upper edge 35 of upper reservoir 13 and below upper external casing packer 31 in cement free zone 38. Upper perforation 43 will allow flow of fluid from upper reservoir 13 through outer annulus 19 into central bore 41 of casing string 17. Following perforation of casing string 17 at upper perforation 43, cement free zone 38 must be cleaned out. This is accomplished by allowing fluid flow from upper reservoir 13 through annulus 19 above lower external casing packer 21, into casing string 17 through upper perforation 43, and then to the surface. Similarly, a lower perforation 39 may be located below lower external casing packer 21 at cement layer 29. Lower perforation 39 will extend through cement layer 29 and allow flow of reservoir fluid from lower reservoir 15 into a central bore 41 of casing string 17. Following perforation of casing string 17 and cement layer 29 at lower perforation 39, the well must be cleaned out as described in more detail below.

Figure 7:
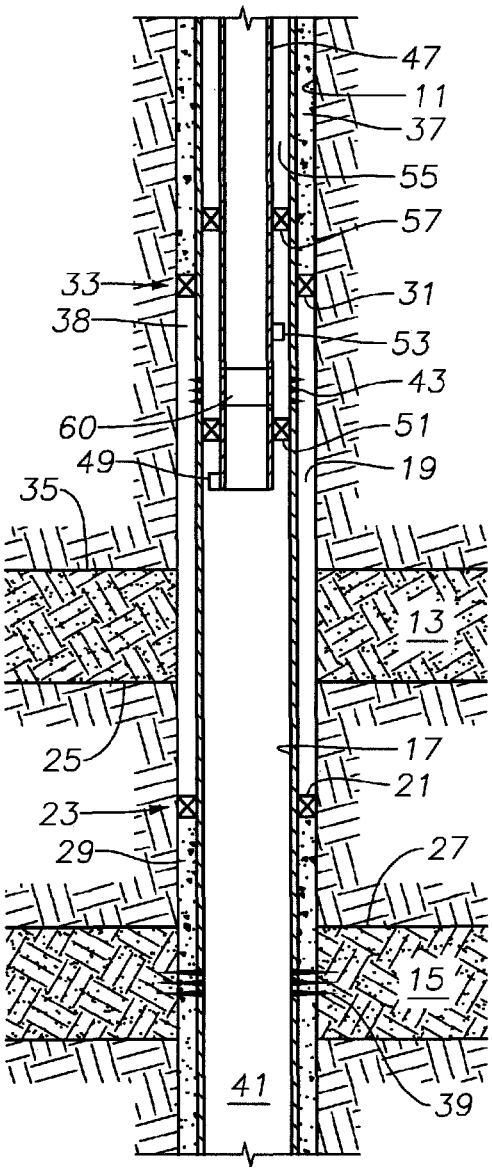

Referring to FIG. 7, a tubing string 47, such as a production tubing string, may be run into casing string 17. Tubing string 47 will include a lower reservoir pressure monitoring gauge (LRPMG) 49 mounted to an outer diameter of tubing string 47. LRPMG 49 may be proximate to an end of tubing string 47 and will be in fluid communication with fluid from lower reservoir 15. Tubing string 47 will also carry a lower tubing packer 51 positioned above LRPMG 49. An upper reservoir pressure monitoring gauge (URPMG) 53 may be mounted to an outer diameter of tubing string 47 above lower tubing packer 51. Tubing string 47 may be run to a location such that an end of tubing string 47 will be at an elevation above upper edge 35 of upper reservoir 13. In this position, lower tubing packer 51 will be within an inner annulus 55 between an inner diameter of casing string 17 and an outer diameter of tubing string 47. As shown, lower tubing packer 51 will be at an elevation below upper perforation 43. Lower tubing packer 51 is set within inner annulus 55 to seal inner annulus 55 from flow of reservoir fluid from lower reservoir 15. In this manner, LRPMG 49 is sealed from fluid flow from upper reservoir 13 and URPMG 53 is sealed from fluid flow from lower reservoir 15.

An upper tubing packer 57 may also be carried by tubing string 47 and set at an elevation above URPMG 53. In the illustrated embodiment, upper tubing packer 57 is set above upper external casing packer 31 at cement layer 37. In this manner, inner annulus 55 is sealed above URPMG 53 to prevent flow of reservoir fluid from upper reservoir 13 to the surface through inner annulus 55. URPMG 53 will be positioned within the sealed area between lower tubing packer 51 and upper tubing packer 57 on the outer diameter of tubing string 47. LRPMG 49 and URPMG 53 may then monitor the reservoir pressure of lower reservoir 15 and upper reservoir 13, respectively. A person skilled in the art will understand that fluid from lower reservoir 15 may flow through tubing string 47, yet not be in communication with fluid from upper reservoir 13. Fluid from upper reservoir 13 may not flow through tubing string 47. By preventing flow from upper reservoir 13 through tubing string 47, pressure interference tests may be conducted between the two reservoirs. The pressure interference testing provides an assessment of the degree of through reservoir communication between upper reservoir 13 and lower reservoir 15. Following running, landing, and setting of tubing string 47, lower tubing packer 51, and upper tubing packer 57, fluid from lower reservoir 15 may circulate through lower perforations 39 to the surface through production tubing 47. This will provide for clean out of debris and other material that was produced during the perforation process discussed above.

Optionally, a circulation sleeve or sliding sleeve tool 60 may be installed in tubing string 47 between upper tubing packer 57 and lower tubing packer 51. As shown, sliding sleeve tool 60 is a device that may be operated by a wireline tool to open and close orifices of sliding sleeve tool 60. When orifices of sliding sleeve tool 60 are open, fluid communication between upper reservoir 13 and tubing string 47 is permitted, allowing for production of fluid from upper reservoir 13 to the surface. In an operative embodiment, a plug or drop ball may be set near an end of tubing string 47 below sliding sleeve tool 60 to seal lower reservoir 15 from flow through tubing string 47. Sliding sleeve tool 60 may then be operated to open orifices to allow fluid communication between upper reservoir 13 and tubing string 47 only. Sliding sleeve 60 may be an open/close sleeve, a choking sleeve, or any other suitable apparatus adapted to shut off flow from a reservoir zone or to regulate pressure between reservoir zones. Open/close sleeves are operable between an open position and a closed position to either allow or prevent fluid flow into tubing string 47 through sliding sleeve 60. Choking sleeves allow for variable flow into tubing string 47 through sliding sleeve 60. Sliding sleeve 60 may be operable through wireline, or hydraulic control. A person skilled in the art will understand that sliding sleeve tool 60 may be any suitable apparatus that allows for selective fluid communication between upper reservoir 13 and tubing string 47.

Figure 8:
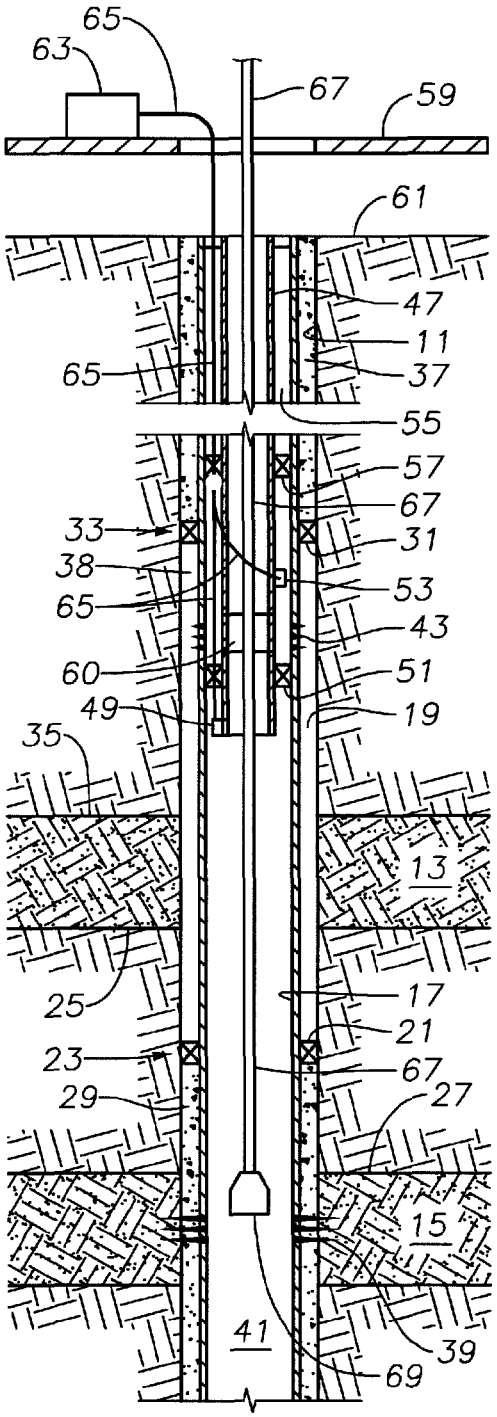
FIGS. 8-9 are schematic representations of pressure and saturation monitoring in accordance with the disclosed embodiments.

As shown in FIG. 8, LRPMG 49 and URPMG 53 may communicate with the surface in any suitable manner such as through acoustic transmitting and receiving equipment, electrical umbilicals, and the like. In the illustrated embodiment, tubing string 47 extends to a surface platform 59 located on a surface 61. Surface platform 59 may be a drilling rig, a workover rig, or any other apparatus suitable to suspend a landing string, or logging string 67 within tubing string 47. A display unit or control unit 63 may be positioned on platform 59 and be communicatively coupled to LRPMG 49 and URPMG 53 through a communications umbilical 65. Communications umbilical 65 may be an electrical or hydraulic umbilical, and may provide communications through upper tubing string packer 57 and lower tubing string packer 51. In alternative embodiments communications umbilical 65 may be run through tubing string 47. In still other embodiments, data from LRPMG 49 and URPMG 53 may be communicated to the surface through acoustic signals transmitted through the wall of tubing string 47. In the illustrated embodiment, control unit 63 may display pressure readings from LRPMG 49 and URPMG 53 in a manner understandable to an operator located on platform 59. This will provide reservoir pressure monitoring for two reservoirs from a single well. A person skilled in the art will understand that reservoir pressures for both reservoirs can be monitored on a continuous basis using control unit 63 or another suitable remote terminal unit.

Following well completion, saturation and production logging operations may be conducted for both upper reservoir 13 and lower reservoir 15. Saturation logging operations may be conducted in a conventional manner for lower reservoir 15. As shown in FIG. 8, a logging tool 69 may be run on logging string 67 through tubing string 47. Logging tool 69 may be a saturation logging tool or a production logging tool depending on the type of logging operation conducted. For saturation logging of lower reservoir 15, logging tool 69 may be a saturation logging tool and will be run below, proximate to, or within lower reservoir 69 adjacent to cement layer 29. Logging tool 69 will then conduct saturation logging operations for determination of a saturation level of lower reservoir 15. Saturation logging operations may include passage of sonic waves, electromagnetic waves, radiation waves, or the like into the formation through casing string 17 and cement layer 29. Logging tool 69 will then register the characteristics of the waves reflected back to the tool by the formation. Based upon the reflected wave characteristics, saturation levels for lower reservoir 15 may be determined. The determination may be done through the collection of data that is stored on logging tool 69 and then accessed when logging tool 69 is retrieved from wellbore 11. In alternative embodiments, logging tool 69 may communicate with the surface while in wellbore 11, such as through control unit 63.

For production logging of lower reservoir 15, logging tool 69 may be a production logging tool and will be run below, proximate to, or adjacent to lower perforations 39. Logging tool 69 will then conduct production logging operations for determination of a production flow profile of lower reservoir 15. Production logging operations may include use of an electromechanical device adapted to register a flow rate through lower perforation 39, sensors adapted to register a flow rate and a fluid phase of fluid passing through lower perforation 39, and the like. The flow rate and fluid phase information may be stored on logging tool 69 and the accessed when logging toll 69 is retrieved from wellbore 11. In alternative embodiments, logging tool 69 may communicate with the surface while in wellbore 11, such as through control unit 63.

Figure 9:
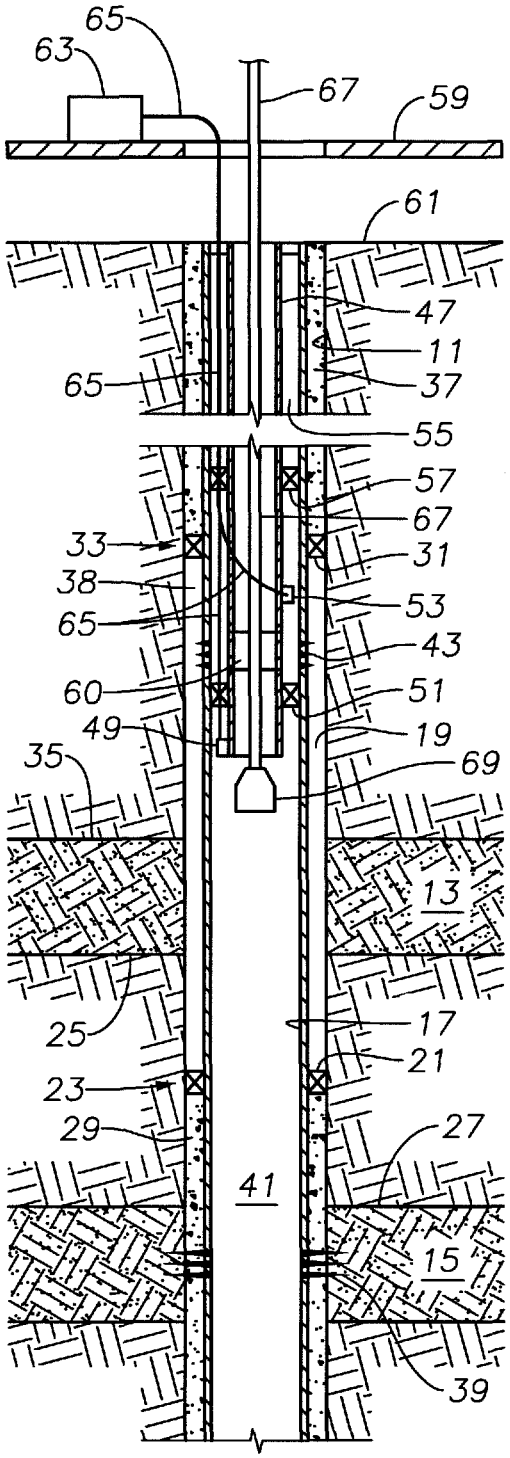

Referring to FIG. 9, logging tool 69 may be run through tubing string 47 on logging string 67 to a location proximate to cement free zone 38. Cement free zone 38 may have an axial height such that logging tool 69 may conduct saturation logging of upper reservoir 13 through cement free zone 38. As shown, logging tool 69 may be a saturation logging tool and may be positioned below an end of tubing string 47. In an exemplary embodiment, logging tool 69 may be positioned below lower edge 25 of upper reservoir 13 while conducting saturation logging of upper reservoir 13. Cement free zone 38 of outer annulus 19 between upper external casing packer 31 and lower external casing packer 21 allows for the saturation logging operation to be conducted for upper reservoir 13 with a higher degree of accuracy than in prior art embodiments. Because there is only casing string 17 between logging tool 69 and upper reservoir 13, the strength of the logging signal as it penetrates upper reservoir 13 is increased. In this manner, saturation logging for upper reservoir 13 may be completed with greater accuracy.

In embodiments including sliding sleeve 60, production logging of upper reservoir 13 may be conducted. As described above, a tubing plug may be run and set in tubing string 47 below sliding sleeve 60. Sliding sleeve 60 may be operated to open orifices of sliding sleeve 60 to allow fluid flow from reservoir 13 through cement free zone 38, through upper perforation 43, and into tubing string 47. Logging tool 69 may be a production logging tool and will be run through tubing string 47 on logging string 67 to a location proximate to open orifices of sliding sleeve 60. Logging tool 69 will then conduct production logging operations for determination of a production flow profile of upper reservoir 13. Production logging operations may include use of an electromechanical device adapted to register a flow rate through orifices of sliding sleeve 60, sensors adapted to register a flow rate and a fluid phase of fluid passing through orifices of sliding sleeve 60, and the like. The flow rate and fluid phase information may be stored on logging tool 69 and the accessed when logging toll 69 is retrieved from wellbore 11. In alternative embodiments, logging tool 69 may communicate with the surface while in wellbore 11, such as through control unit 63.

Accordingly, the disclosed embodiments provide a well completion method that allows continuous real time reservoir independent pressure monitoring for two reservoirs from a single well. In addition, the well completion method creates a cement free zone of an annulus between a casing string and a wellbore that allows for accurate saturation logging of two fluid reservoirs. Accurate saturation logging may be accomplished because there is no tubing string across both reservoirs and only one casing string across both reservoirs. Still further, the disclosed well completion method provides for production logging from a reservoir in a cemented area of the wellbore.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A well completion method comprising the steps of:

(a) drilling a wellbore through an upper reservoir and a lower reservoir that are within a subterranean formation, wherein the upper reservoir is at a higher elevation than the lower reservoir;

(b) running a casing string through the upper and the lower reservoir;

(c) setting a lower external casing packer between the upper and the lower reservoirs in an outer annulus between the outer diameter of the casing string and the wellbore;

(d) setting an upper external casing packer in the outer annulus above the upper reservoir;

(e) cementing the outer annulus below the lower external casing packer;

(f) cementing the outer annulus above the upper external casing packer, thereby creating a cement free zone in the outer annulus between the lower external casing packer and the upper external casing packer to facilitate logging measurements of the upper reservoir; and (g) saturation logging in the cement free zone, after cementing the outer annulus below the lower external casing packer and after cementing the outer annulus above the upper external casing packer to obtain information about the subterranean formation adjacent the cement free zone.

2. The method of claim 1, further comprising:

perforating the casing string with an upper perforation into the cement free zone between the upper reservoir and the upper external casing packer; and perforating the casing string with a lower perforation into the lower reservoir.

3. The method of claim 2, further comprising:

after perforating the casing string with an upper perforation into the cement free zone, cleaning out the cement free zone by allowing for production of reservoir fluid from the upper reservoir through the casing string; then perforating the casing string with another lower perforation into the lower reservoir.

4. The method of claim 2, further comprising:

mounting upper and lower tubing packers to a tubing string and mounting upper and lower monitoring gauges to an exterior of the tubing string, wherein the lower tubing packer is between lower and upper gauges and the upper tubing packer is above the upper gauge;

running the tubing string through the bore of the casing string so that a lower end of the tubing string is below the upper perforation;

setting the lower tubing string packer in an inner annulus between the tubing string and the casing string above the upper reservoir;

setting the upper tubing string packer in the inner annulus above the upper perforation;

communicating well fluid to the lower gauge from the lower perforation and monitoring pressure of the lower reservoir; and communicating well fluid to the upper gauge from the upper perforation and monitoring pressure of an upper formation.

5. The method of claim 4, further comprising:

communicatively coupling the lower reservoir pressure monitoring gauge for the lower reservoir to a display unit located on a surface; and transmitting a lower reservoir pressure to the display unit for display of the lower reservoir pressure to an operator.

6. The method of claim 4, further comprising positioning the upper gauge above the upper perforation.

7. The method of claim 4, further comprising:

communicatively coupling the upper reservoir pressure monitoring gauge for the upper reservoir to a display unit located on a surface; and transmitting an upper reservoir pressure to the display unit for display of the upper reservoir pressure to an operator.

8. The method of claim 4, further comprising:

lowering a logging instrument through and below the tubing string; and wherein the step of conducting logging operations of the upper reservoir comprises sending and receiving signals through the cement free zone between the upper external casing packer and the lower external casing packer.

9. The method of claim 4, further comprising:

lowering a logging instrument through and below an end of the tubing string; and conducting logging operations of the lower reservoir by sending and receiving signals through the lower perforation below the lower external casing packer.

10. The method of claim 4, wherein the lower end of the tubing string is above the upper reservoir.

11. The method of claim 4, further comprising:

coupling a sliding sleeve tool in the tubing string between the upper pressure reservoir monitoring gauge and the upper tubing packer;

setting a plug near an end of the tubing string below the sliding sleeve tool;

operating the sliding sleeve tool to open orifices of the sliding sleeve tool for fluid communication between the upper reservoir and the tubing string;

lowering a logging instrument through the tubing string to a location proximate to the open orifices of the sliding sleeve tool; and conducting logging operations of the upper reservoir through the open orifices of the sliding sleeve tool.

12. A monitoring well for pressure and saturation monitoring of two subsurface fluid reservoirs, wherein the two reservoirs are at different vertical elevations, the well comprising:

a wellbore drilled from a surface through the upper reservoir and the lower reservoir;

a casing string disposed within the wellbore so that the casing string extends through the upper reservoir and into the lower reservoir;

a lower external casing packer set at an elevation between the lower reservoir and the upper reservoir;

an upper external casing packer set at an elevation above the upper reservoir;

cement in an outer annulus between the casing string and the wellbore and below the lower external casing packer and above the upper external casing packer to create a cement free zone that facilitates logging measurements of the upper reservoir; and a saturation logging tool strategically disposed adjacent the cement free zone, so that when the logging tool conducts logging operations of the upper reservoir through the cement free zone, images of a formation set radially outward from adjacent the wellbore are obtained through the cement free zone and at a time after the cement was disposed in the outer annulus.

13. The monitoring well of claim 12, further comprising:

wherein the casing string is perforated with a lower perforation through the cement layer located across the lower reservoir;

wherein the casing string is perforated with an upper perforation in the cement free zone;

a tubing string suspended within the casing string, the tubing string sealed to the casing string by a lower tubing packer and an upper tubing packer;

wherein the lower tubing packer is positioned between the upper perforation and an upper formation;

wherein the upper tubing packer is positioned above the upper perforation;

wherein the upper perforation is in fluid communication with the cement free zone and the upper reservoir; and wherein the lower perforation is in fluid communication with the lower reservoir.

14. The monitoring well of claim 13, wherein a lower reservoir pressure monitoring gauge is mounted to an outer diameter end of the tubing string below the lower tubing packer for monitoring a reservoir pressure of the lower reservoir.

15. The monitoring well of claim 13, wherein an upper reservoir pressure monitoring gauge is mounted to an outer diameter of the tubing string between the lower tubing packer and the upper tubing packer for monitoring a reservoir pressure of the upper reservoir.

16. The monitoring well of claim 13, wherein:

a lower reservoir pressure monitoring gauge is mounted to an outer diameter end of the tubing string below the lower tubing packer for monitoring a reservoir pressure of the lower reservoir; and an upper reservoir pressure monitoring gauge is mounted to an outer diameter of the tubing string between the lower tubing packer and the upper tubing packer and adjacent the cement free zone for monitoring a reservoir pressure of the upper reservoir.

17. The monitoring well of claim 16, wherein the upper and lower pressure monitoring gauges are communicatively coupled to a display at the surface for displaying a pressure of the upper reservoir and the lower reservoir to an operator.

18. The monitoring well of claim 13, further comprising a logging instrument suspended on a drill string through and below the tubing string to conduct logging operations of the upper reservoir by sending and receiving signals through the cement free zone between the upper external casing packer and the lower external casing packer.

19. The monitoring well of claim 13, further comprising a logging instrument suspended on a drill string through and below the tubing string to conduct logging operations of the lower reservoir by sending and receiving signals through the lower perforation below the lower external casing packer.

20. The monitoring well of claim 13, further comprising a sliding sleeve tool coupled to the tubing string between the upper reservoir pressure monitoring gauge and the lower tubing packer, the sliding sleeve tool adapted to operate in response to a signal from the surface to allow fluid communication between the upper reservoir and the tubing string.

21. A system for monitoring pressure and saturation of two reservoirs from a single well, the system comprising:

a wellbore drilled through an upper reservoir and a lower reservoir;

a casing string suspended within the wellbore, the casing string defining a wellbore annulus between the casing string and the wellbore;

a tubing string suspended within the casing string, the tubing string defining a tubing string annulus between the tubing string and the casing string;

cement across the lower reservoir to create a cement layer and a void across the upper reservoir to define a cement free zone;

a lower tubing packer set above the upper reservoir;

a lower monitoring gauge mounted on the tubing string below the lower packer that is in pressure communication with the lower reservoir;

an upper gauge mounted above the lower packer that is in pressure communication with the upper reservoir;

an upper tubing packer set above the upper gauge; and a saturation logging tool adjacent the cement free zone, so that when the logging tool conducts logging operations of the upper reservoir through the cement free zone at a time after the cement layer was provided across the lower reservoir to define the cement free zone, images of a formation in the upper reservoir are obtained through the cement free zone, and where the images are of formation that is spaced radially outward from a wall of the wellbore.

22. The system of claim 21, further comprising a sliding sleeve tool coupled in the tubing string between the upper monitoring gauge and the lower tubing packer, the sliding sleeve tool adapted to selectively allow production from the upper reservoir.

23. The system of claim 21, wherein the system further comprises:

an upper perforation in the casing string at the uncemented portion so that fluid may flow from the upper reservoir, through the annulus between the casing string and the wellbore, and into the sealed portion of the tubing string annulus to the upper gauge; and a lower perforation in the casing string into the lower reservoir so that fluid may flow from the lower reservoir, through the cement layer, and into communication with the lower gauge.

24. The system of claim 21, further comprising a logging instrument suspended on a drill string through and below the tubing string to conduct logging operations of the upper reservoir by sending and receiving signals through the cement free zone between the upper external casing packer and the lower external casing packer.

25. The system of claim 24, wherein:

the logging instrument is a production logging tool;

the logging operations are production logging operations; and the production logging tool sends and receives signals through open orifices of a sliding sleeve tool.

26. The system of claim 21, further comprising a logging instrument suspended on a drill string through and below the tubing string to conduct logging operations of the lower reservoir through the lower perforation below the lower external casing packer.

* * * * *